US009085964B2

(12) United States Patent
Sherrill et al.

(10) Patent No.: US 9,085,964 B2
(45) Date of Patent: Jul. 21, 2015

(54) FORMATION TESTER PAD

(75) Inventors: Kristopher V. Sherrill, Humble, TX (US); James E. Stone, Porter, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/063,709

(22) PCT Filed: May 20, 2009

(86) PCT No.: PCT/US2009/044608

§ 371 (c)(1), (2), (4) Date: Mar. 11, 2011

(87) PCT Pub. No.: WO2010/134912

PCT Pub. Date: Nov. 25, 2010

(65) Prior Publication Data

US 2012/0111632 A1 May 10, 2012

(51) Int. Cl.
*E21B 49/10* (2006.01)

(52) U.S. Cl.
CPC ..... *E21B 49/10* (2013.01)

(58) Field of Classification Search
CPC ..... E21B 49/10
USPC ..... 73/152.24, 152.26; 166/100; 277/322, 277/337
See application file for complete search history.

(56) References Cited

U.S. PATENT DOCUMENTS 3,171,485 A 3/1965 White, Jr.
3,173,485 A 3/1965 Bretzke, Jr.
3,212,574 A 10/1965 Fox
3,324,712 A 6/1967 Watson et al.
3,490,776 A * 1/1970 Avery ..... 277/649
3,530,933 A 9/1970 Whitten
3,565,119 A 2/1971 Pierpont, Jr.
3,565,169 A 2/1971 Bell
3,599,719 A 8/1971 Brown
3,658,127 A 4/1972 Cochran et al.
3,659,647 A 5/1972 Brown (Continued)

FOREIGN PATENT DOCUMENTS

CA 1108985 9/1981
CA 1167761 5/1984

(Continued)

OTHER PUBLICATIONS

International Application No. PCT/US2009/044608 Search Report and Written Opinion dated Feb. 18, 2010.

(Continued)

*Primary Examiner* — John Fitzgerald

(57) ABSTRACT

A formation tester seal pad includes a support member and a deformable seal pad element including an outer sealing surface having a plurality of raised portions and adjacent spaces. In some embodiments, the raised portions are deformable into the adjacent spaces in response to a compressive load on the outer sealing surface. In some embodiments, the support member includes an inner raised edge and an outer raised edge to capture the deformable seal pad element. In some embodiments, a deformable seal pad element includes a volume of seal pad material above a support member outer profile and a volume of space below the outer profile. In some embodiments, the space volume receives a portion of the seal pad volume in response to a compressive load.

6 Claims, 11 Drawing Sheets

(56) References Cited

U.S. PATENT DOCUMENTS

| | | | | |
|---|---|---|---|---|
| 3,673,864 | A | | 7/1972 | Cubberly, Jr. |
| 3,776,561 | A | | 12/1973 | Haney |
| 3,811,321 | A | | 5/1974 | Urbanosky |
| 3,813,936 | A | | 6/1974 | Urbanosky et al. |
| 3,858,445 | A | | 1/1975 | Urbanosky |
| 3,859,850 | A | | 1/1975 | Whitten et al. |
| 3,859,851 | A | | 1/1975 | Urbanosky |
| 3,864,970 | A | | 2/1975 | Bell |
| 3,868,826 | A | | 3/1975 | Landers |
| 3,924,463 | A | | 12/1975 | Urbanosky |
| 3,934,468 | A | | 1/1976 | Brieger |
| 3,952,588 | A | | 4/1976 | Whitten |
| 4,003,581 | A | | 1/1977 | Hutchinson |
| 4,046,011 | A | | 9/1977 | Olsen |
| 4,053,354 | A | | 10/1977 | Kitsnik |
| 4,146,092 | A | | 3/1979 | Upton |
| 4,161,319 | A | | 7/1979 | Stocking |
| 4,210,018 | A | | 7/1980 | Brieger |
| 4,224,987 | A | | 9/1980 | Allen |
| 4,234,197 | A | | 11/1980 | Amancharla |
| 4,246,782 | A | | 1/1981 | Hallmark |
| 4,248,081 | A | | 2/1981 | Hallmark |
| 4,252,195 | A | | 2/1981 | Fredd |
| 4,270,385 | A | | 6/1981 | Hallmark |
| 4,287,946 | A | | 9/1981 | Brieger |
| 4,288,082 | A | | 9/1981 | Setterberg, Jr. |
| 4,289,200 | A | | 9/1981 | Fisher, Jr. |
| 4,292,842 | A | | 10/1981 | Hallmark |
| 4,302,018 | A | | 11/1981 | Harvey et al. |
| 4,323,256 | A | | 4/1982 | Miyagishima et al. |
| 4,339,948 | A | | 7/1982 | Hallmark |
| 4,416,152 | A | | 11/1983 | Wilson |
| 4,434,653 | A | | 3/1984 | Montgomery |
| 4,441,721 | A | | 4/1984 | Harris et al. |
| 4,444,400 | A | | 4/1984 | Norman |
| 4,452,463 | A | | 6/1984 | Buckner |
| 4,482,086 | A | | 11/1984 | Wagner et al. |
| 4,500,095 | A | | 2/1985 | Schisler et al. |
| 4,507,957 | A | | 4/1985 | Montgomery et al. |
| 4,512,399 | A | | 4/1985 | Gano et al. |
| 4,513,612 | A | | 4/1985 | Shalek |
| 4,535,843 | A | | 8/1985 | Jagler |
| 4,579,314 | A | | 4/1986 | Schaeper et al. |
| 4,589,485 | A | | 5/1986 | Wray |
| 4,593,560 | A | | 6/1986 | Purfurst |
| 4,610,158 | A | | 9/1986 | Lawton, Jr. |
| 4,635,717 | A | | 1/1987 | Jaegler |
| 4,638,860 | A | | 1/1987 | Magee, Jr. et al. |
| 4,745,802 | A | | 5/1988 | Purfurst |
| 4,753,444 | A | | 6/1988 | Jackson et al. |
| 4,765,404 | A | | 8/1988 | Bailey et al. |
| 4,843,878 | A | | 7/1989 | Purfurst et al. |
| 4,845,982 | A | | 7/1989 | Gilbert |
| 4,860,580 | A | | 8/1989 | DuRocher |
| 4,860,581 | A | | 8/1989 | Zimmerman et al. |
| 4,862,967 | A | | 9/1989 | Harris |
| 4,879,900 | A | | 11/1989 | Gilbert |
| 4,884,439 | A | | 12/1989 | Baird |
| 4,890,487 | A | | 1/1990 | Dussan et al. |
| 4,936,139 | A | | 6/1990 | Zimmerman et al. |
| 4,941,350 | A | | 7/1990 | Schneider |
| 4,951,749 | A | | 8/1990 | Carroll |
| 5,056,595 | A | | 10/1991 | Desbrandes |
| 5,095,745 | A | | 3/1992 | Desbrandes |
| 5,101,907 | A | | 4/1992 | Schultz et al. |
| 5,148,705 | A | | 9/1992 | Desbrandes |
| 5,184,508 | A | | 2/1993 | Desbrandes |
| 5,230,244 | A | | 7/1993 | Gilbert |
| 5,231,874 | A | | 8/1993 | Gilbert |
| 5,233,866 | A | | 8/1993 | Desbrandes |
| 5,238,070 | A | | 8/1993 | Schultz et al. |
| 5,249,461 | A | | 10/1993 | Ponder et al. |
| 5,265,015 | A | | 11/1993 | Auzerais et al. |
| 5,269,180 | A | | 12/1993 | Dave et al. |
| 5,279,153 | A | | 1/1994 | Dussan et al. |
| 5,303,775 | A | | 4/1994 | Michaels et al. |
| 5,311,938 | A | | 5/1994 | Hendrickson et al. |
| 5,318,117 | A | | 6/1994 | Echols, III et al. |
| 5,329,811 | A | | 7/1994 | Schultz et al. |
| 5,335,542 | A | | 8/1994 | Ramakrishnan et al. |
| 5,377,755 | A | | 1/1995 | Michaels et al. |
| 5,390,738 | A | | 2/1995 | Eslinger et al. |
| 5,390,939 | A | * | 2/1995 | Terauchi et al. ..... 277/650 |
| 5,433,269 | A | | 7/1995 | Hendrickson |
| 5,473,939 | A | | 12/1995 | Leder et al. |
| 5,489,740 | A | | 2/1996 | Fletcher |
| 5,549,159 | A | | 8/1996 | Shwe et al. |
| 5,587,525 | A | | 12/1996 | Shwe et al. |
| 5,602,334 | A | | 2/1997 | Proett et al. |
| 5,604,130 | A | | 2/1997 | Warner et al. |
| 5,622,223 | A | | 4/1997 | Vasquez |
| 5,635,631 | A | | 6/1997 | Yesudas et al. |
| 5,644,076 | A | | 7/1997 | Proett et al. |
| 5,676,213 | A | | 10/1997 | Auzerais et al. |
| 5,741,962 | A | | 4/1998 | Birchak et al. |
| 5,743,333 | A | | 4/1998 | Willauer et al. |
| 5,803,186 | A | | 9/1998 | Berger et al. |
| 5,826,662 | A | | 10/1998 | Beck et al. |
| 5,857,520 | A | | 1/1999 | Mullen et al. |
| 5,934,374 | A | | 8/1999 | Hrametz et al. |
| 5,961,123 | A | | 10/1999 | Ingram et al. |
| 5,992,522 | A | | 11/1999 | Boyd et al. |
| 6,007,067 | A | | 12/1999 | Hiorth |
| 6,047,239 | A | | 4/2000 | Berger et al. |
| 6,203,020 | B1 | | 3/2001 | Mireles, Jr. et al. |
| 6,230,798 | B1 | | 5/2001 | Appleton |
| 6,250,638 | B1 | | 6/2001 | Youngquist |
| 6,301,959 | B1 | | 10/2001 | Hrametz et al. |
| 6,557,640 | B1 | | 5/2003 | Cook et al. |
| 6,565,093 | B2 | * | 5/2003 | Crow et al. ..... 277/337 |
| 6,568,487 | B2 | | 5/2003 | Meister et al. |
| 6,658,930 | B2 | | 12/2003 | Abbas |
| 7,090,012 | B2 | | 8/2006 | Hill et al. |
| 7,114,562 | B2 | | 10/2006 | Fissler et al. |
| 7,121,338 | B2 | | 10/2006 | van Zuilekom et al. |
| 7,128,144 | B2 | | 10/2006 | Fox et al. |
| 7,204,309 | B2 | | 4/2007 | Segura et al. |
| 7,260,985 | B2 | | 8/2007 | Gilbert et al. |
| 7,395,879 | B2 | | 7/2008 | Segura et al. |
| 2001/0035289 | A1 | | 11/2001 | Runia |
| 2002/0189339 | A1 | | 12/2002 | Montalvo et al. |
| 2003/0068599 | A1 | | 4/2003 | Balfour et al. |
| 2003/0098162 | A1 | | 5/2003 | Cook |
| 2003/0145652 | A1 | | 8/2003 | Arian |
| 2004/0079909 | A1 | | 4/2004 | Foster |
| 2004/0173351 | A1 | | 9/2004 | Fox et al. |
| 2005/0072565 | A1 | | 4/2005 | Segura et al. |
| 2005/0109538 | A1 | | 5/2005 | Fissler et al. |
| 2005/0155760 | A1 | | 7/2005 | Hill et al. |
| 2005/0161218 | A1 | | 7/2005 | van Zuilekom et al. |
| 2005/0257611 | A1 | | 11/2005 | Fogal et al. |
| 2007/0007008 | A1 | | 1/2007 | Sherrill |
| 2007/0181341 | A1 | | 8/2007 | Segura et al. |
| 2008/0000646 | A1 | * | 1/2008 | Thomson ..... 166/387 |
| 2008/0295588 | A1 | | 12/2008 | van Zuilekom et al. |

FOREIGN PATENT DOCUMENTS

| | | | |
|---|---|---|---|
| CA | 1182393 | | 2/1985 |
| CA | 1212315 | | 10/1986 |
| CA | 1280362 | | 2/1991 |
| CA | 2103096 | A1 | 5/1994 |
| CA | 2096068 | | 6/1998 |
| CA | 2318157 | A1 | 7/1999 |
| CA | 2215422 | | 4/2002 |
| CA | 2389123 | A1 | 6/2002 |
| CA | 2185169 | | 10/2002 |
| CA | 2185170 | | 10/2002 |
| CA | 2204329 | | 3/2005 |
| CN | 1356452 | A | 7/2002 |
| EP | 0102756 | A1 | 3/1984 |
| EP | 0250107 | A2 | 12/1987 |
| EP | 0453051 | A2 | 10/1991 |
| EP | 0453052 | A2 | 10/1991 |

(56) References Cited

FOREIGN PATENT DOCUMENTS

| | | | |
|---|---|---|---|
| EP | 0497588 | A1 | 8/1992 |
| EP | 0599422 | A2 | 6/1994 |
| EP | 0978630 | A2 | 9/2000 |
| FR | 2789469 | A1 | 8/2000 |
| GB | 1455955 | | 11/1976 |
| GB | 2204922 | A | 11/1988 |
| GB | 2226908 | A | 7/1990 |
| GB | 2283516 | A | 5/1995 |
| GB | 2312908 | A | 11/1997 |
| GB | 2328229 | A | 2/1999 |
| GB | 2333310 | A | 7/1999 |
| GB | 2350635 | A | 6/2000 |
| GB | 2378719 | A | 2/2003 |
| RU | 2097555 | C1 | 11/1997 |
| RU | 2120023 | C1 | 10/1998 |
| RU | 2128278 | C1 | 3/1999 |
| RU | 2201495 | C2 | 10/2000 |
| SU | 306745 | | 11/1966 |
| SU | 1735575 | A1 | 5/1992 |
| SU | 1745894 | A1 | 7/1992 |
| SU | 1763646 | A1 | 9/1992 |
| WO | 81/02457 | A1 | 9/1981 |
| WO | 9639481 | | 12/1996 |
| WO | 97/28348 | A1 | 8/1997 |
| WO | 99/36663 | A1 | 7/1999 |
| WO | 00/43812 | A1 | 7/2000 |
| WO | 01/98630 | A1 | 12/2001 |
| WO | 03097999 | A1 | 11/2003 |
| WO | 2004081334 | A2 | 9/2004 |
| WO | 2005072430 | A2 | 8/2005 |
| WO | 2007005071 | A1 | 1/2007 |
| WO | 2007146801 | A2 | 12/2007 |

OTHER PUBLICATIONS

G D. Phelps et al.;"The Effect of Filtrate Invasion and Formation Wettability on Repeat Formation Tester Measurements"; 1984 European Petroleum Conference; Oct. 25-28, 1984; pp. 59-68 with Figures 1-12; SPE 12962; Society of Pertroleum Engineers of AIME; London, England.

Mark A. Proett et al.; "Supercharge Pressure Compensation Using a New Wireline Testing Method and Newly Developed Early Time Spherical Flow Model"; 1996 SPE Annual Technical Conference and Exhibition; Oct. 6-9, 1996; pp. 329-342; SPE 36524; Society of Petroleum Engineers, Inc.; Denver, Colorado, U.S.A.

W. B. Underhill et al.; "Model-Based Sticking Risk Assessment for Wireline Formation Testing Tools in the U.S. Gulf Coast"; 1998 SPE Annual Technical Conference and Exhibition; Sep. 27-30, 1998; pp. 79-89; SPE 48963; Society of Petroleum Engineers, Inc.; New Orleans, Louisiana, U.S.A.

R. Parkes et al.; "New Techniques in Wireline Formation Testing in Tight Reservoirs"; 1998 SPE Asia Pacific Oil & Gas Conference and Exhibition; Oct. 12-14, 1998; pp. 419-430; SPE 50128; Society of Petroleum Engineers, Inc.; Perth, Australia.

Amit K. Sakar et al.; "Adverse Effects of Poor Mudcake Quality: A Supercharging and Fluid Sampling Study"; SPE Reservoir Eval. & Eng. 3 (3); Jun. 2000; pp. 256-262; Society of Petroleum Engineers, Inc.; U.S.A.

Hui Xu et al.; "In Situ Filtrate Flowrate Measurements With the Wireline Formation Tester"; SPWLA 34th Annual Logging Symposium; Jun. 13-16, 1993; pp. 1-15.

Margaret C. Waid et al.; "Interpretation of Wireline Formation Tester Pressure Response With Combined Flowline and Chamber Storage, Mud Supercharging and Mud Invasion Effects"; SPWLA 33rd Annual Logging Symposium; Jun. 14-17, 1992; pp. 1-25.

Halliburton MRILab.RTM. Service product brochure; pp. 124-125; 2003.

R. Desbrandes et al.; "A New Concept in Wireline Formation Testing: Extended Drawdown"; 13th CWLS Formation Evaluation Symp.; 1991; Calgary, Canada; pp. 1-25.

"Well Testing Using Wireline Methods"; Schlumberger S. East Asia Well Evaluation Conference; Oct. 1981; pp. 121-144.

L Moinard et al.; "Permeability Quantification from Borehole Stoneley Waves"; Proceedings Second Int. Pet. Conf. & Exbn.; pp. 547-558; Petrotech-97; New Delhi, India.

A. A. Adeyemi-Bero et al.; "First Horizontal Well in the Shallow, Unconsolidated Sand and Viscous/Heavy Oil Reservoir of the Sapele Field, Nigeria"; 17th Annual Conference of the Society of Petroleum Engineers, Nigeria Council; 1993 pp. 71-84; SPENC 9308; Society of Petroleum Engineers, Nigeria Council; Warri, Nigeria.

Robert Desbrandes; "Wireline Formation Testing: A New Extended Drawdown Technique"; Petroleum Engineer International, May 1991; pp. 40-44; vol. 63, No. 5.

Neal G. Skinner et al.; "Formation-Pressure Test Tools: Pt. 2: Pressure Test Validity Shown by Comparing Field Tests and Simulations"; Oil & Gas Journal; Jan. 12, 1998; pp. 46-48.

R. Desbrandes et al.; "Wettability and Productivity Characterization of Low Permeability Gas Formations: Topical Report"; Gas Research Institute; Report GRI-92/0405; Dec. 1992.

L. Lin; "Reservoir Characterization with RFT Logs Using a Modes for Anisotropic Model"; SPWLA/China Petroleum Society Well Logging Joint Symposium; May 17-20, 1994; pp. 307-313; Xian, China.

R. Desbrandes et al.; "Wettability and Productivity Characterizations of Low Premeability Gas Formations: Annual Report"; Gas Research Institute; Report GRI-91/0135; Mar. 1991.

International Application No. PCT/US2005/003039 Search Report and Written Opinion dated Nov. 10, 2005.

Australian Patent Examination Report, Patent Application No. 2009346365, Jan. 8, 2015, 3 pages.

* cited by examiner

FORMATION TESTER PAD

This application is the U.S. National Stage under 35 U.S.C. §371 of International Patent Application No. PCT/US2009/044608 filed May 20, 2009, entitled "Formation Tester Pad."

STATEMENT REGARDING FEDERALLY SPONSORED RESEARCH DEVELOPMENT

Not applicable

BACKGROUND OF THE INVENTION

During the drilling and completion of oil and gas wells, it may be necessary to engage in ancillary operations, such as evaluating the production capabilities of formations intersected by the wellbore. For example, after a well or well interval has been drilled, zones of interest are often tested to determine various formation properties such as permeability, fluid type, fluid quality, formation temperature, formation pressure, bubblepoint and formation pressure gradient. These tests are performed in order to determine whether commercial exploitation of the intersected formations is viable and how to optimize production. The acquisition of accurate data from the wellbore is critical to the optimization of hydrocarbon wells. This wellbore data can be used to determine the location and quality of hydrocarbon reserves, whether the reserves can be produced through the wellbore, and for well control during drilling operations.

A downhole tool is used to acquire and test a sample of fluid from the formation. More particularly, a probe assembly is used for engaging the borehole wall and acquiring the formation fluid samples. The probe assembly may include an isolation pad to engage the borehole wall. The isolation pad seals against the formation and around a hollow sample probe, creating a sealing arrangement that creates a seal between the sample probe and the formation in order to isolate the probe from wellbore fluids. The sealed probe arrangement also places an internal cavity of the tool in fluid communication with the formation. This creates a fluid pathway that allows formation fluid to flow between the formation and the formation tester while isolated from the borehole fluids. The fluid pathway may be enhanced by extending the sample probe to couple to the formation.

In order to acquire a useful sample, the probe must stay isolated from the relative high pressure of the borehole fluid. Therefore, the integrity of the seal that is formed by the isolation pad is critical to the performance of the tool. If the borehole fluid is allowed to leak into the collected formation fluids, a non-representative sample will be obtained and the test will have to be repeated.

Formation testing tools may be used in conjunction with wireline logging operations or as a component of a logging-while-drilling (LWD) or measurement-while-drilling (MWD) package. In wireline logging operations, the drill string is removed from the wellbore and measurement tools are lowered into the wellbore using a heavy cable (wireline) that includes wires for providing power and control from the surface. In LWD and MWD operations, the measurement tools are integrated into the drill string and are ordinarily powered by batteries and controlled by either on-board or remote control systems. With LWD/MWD testers, the testing equipment is subject to harsh conditions in the wellbore during the drilling process that can damage and degrade the formation testing equipment before and during the testing process. These harsh conditions include vibration and torque from the drill bit, exposure to drilling mud, drilled cuttings, and formation fluids, hydraulic forces of the circulating drilling mud, high downhole temperatures, and scraping of the formation testing equipment against the sides of the wellbore. Sensitive electronics and sensors must be robust enough to withstand the pressures and temperatures, and especially the extreme vibration and shock conditions of the drilling environment, yet maintain accuracy, repeatability, and reliability.

A generic formation tester is lowered to a desired depth within a wellbore. The wellbore is filled with mud, and the wall of the wellbore is coated with a mudcake. Once the formation tester is at the desired depth, it is set in place and an isolation pad is extended to engage the mudcake. The isolation pad seals against mudcake and around the hollow sample probe, which places an internal cavity in fluid communication with the formation. This creates the fluid pathway that allows formation fluid to flow between the formation and the formation tester while isolated from wellbore fluids.

The isolation or seal pad is generally a simple rubber pad affixed to a metal support member. The outer sealing surface is cylindrical or spherical. Stresses from use and downhole pressures and temperatures tend to quickly fatigue the rubber pad, leading to premature failure. Therefore, there remains a need to develop an isolation or seal pad that provides reliable sealing performance with an increased durability and resistance to stress. In this manner, an extended seal pad life provides an increased number of tests that can be performed without replacing the pad.

BRIEF DESCRIPTION OF THE DRAWINGS

For a detailed description of exemplary embodiments of the invention, reference will now be made to the accompanying drawings in which.

DETAILED DESCRIPTION OF THE PREFERRED EMBODIMENTS

Figure 1:
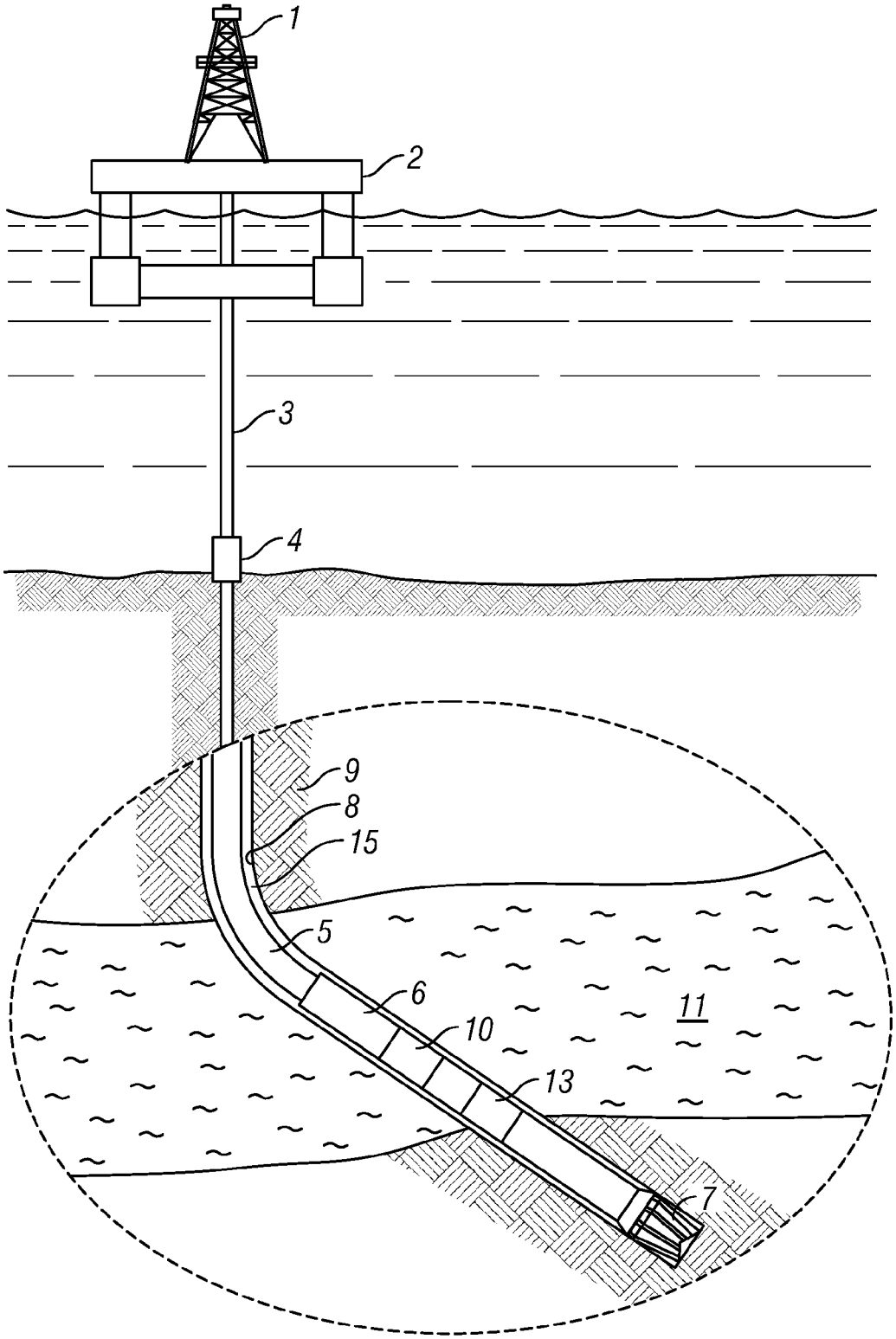
FIG. 1 is a schematic view, partly in cross-section, of a drilling apparatus with a formation tester.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. Also, the designation "MWD" or "LWD" are used to mean all generic measurement while drilling or logging while drilling apparatus and systems. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, a drilling apparatus including a formation tester is shown. A formation tester 10 is shown enlarged and schematically as a part of a bottom hole assembly 6 including a sub 13 and a drill bit 7 at its distal most end. The bottom hole assembly 6 is lowered from a drilling platform 2, such as a ship or other conventional land platform, via a drill string 5. The drill string 5 is disposed through a riser 3 and a well head 4. Conventional drilling equipment (not shown) is supported within a derrick 1 and rotates the drill string 5 and the drill bit 7, causing the bit 7 to form a borehole 8 through formation material 9. The drill bit 7 may also be rotated using other means, such as a downhole motor. The borehole 8 penetrates subterranean zones or reservoirs, such as reservoir 11, that are believed to contain hydrocarbons in a commercially viable quantity. An annulus 15 is formed thereby. In addition to the tool 10, the bottom hole assembly 6 contains various conventional apparatus and systems, such as a down hole drill motor, a rotary steerable tool, a mud pulse telemetry system, MWD or LWD sensors and systems, and others known in the art.

Figure 2:
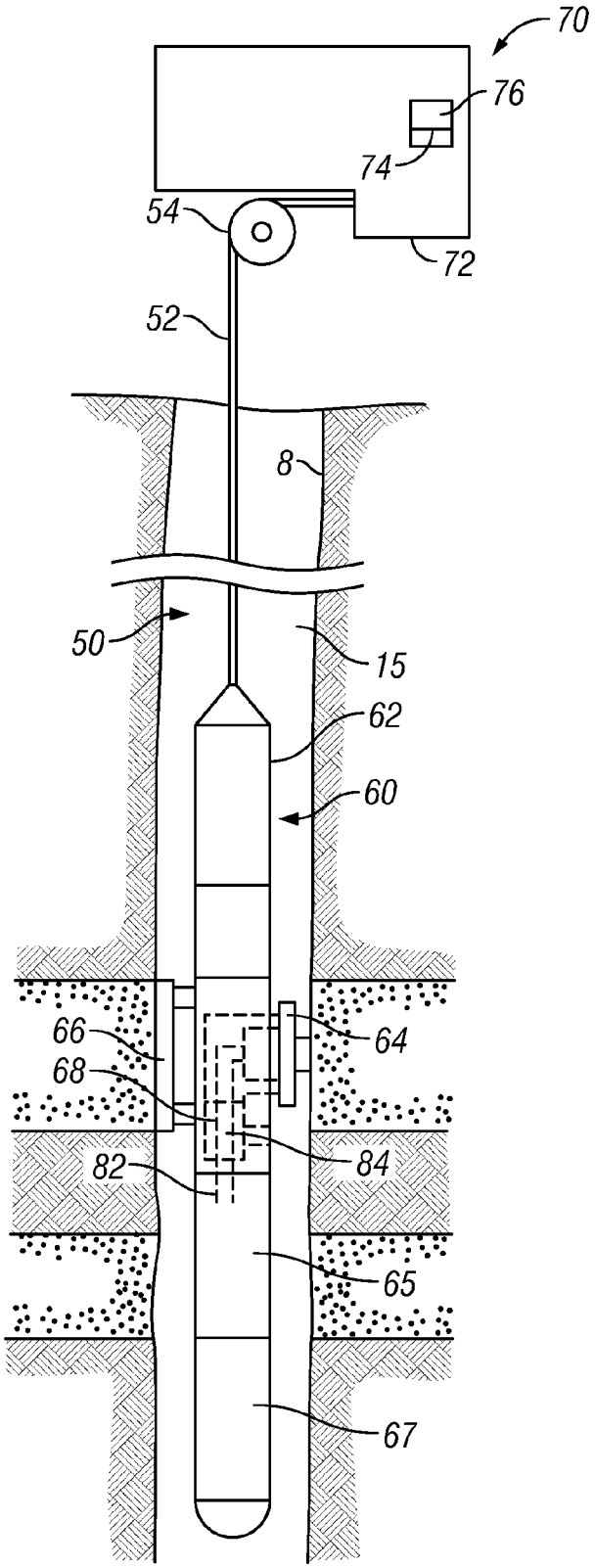
FIG. 2 is a schematic view, partly in cross-section, of a formation tester conveyed by wireline.

In some embodiments, and with reference to FIG. 2, a formation testing tool 60 is disposed on a tool string 50 conveyed into the borehole 8 by a cable 52 and a winch 54. The testing tool includes a body 62, a sampling assembly 64, a backup assembly 66, analysis modules 68, 84 including electronic devices, a flowline 82, a battery module 65, and an electronics module 67. The formation tester 60 is coupled to a surface unit 70 that may include an electrical control system 72 having an electronic storage medium 74 and a control processor 76. In other embodiments, the tool 60 may alternatively or additionally include an electrical control system, an electronic storage medium and a processor.

Figure 3:
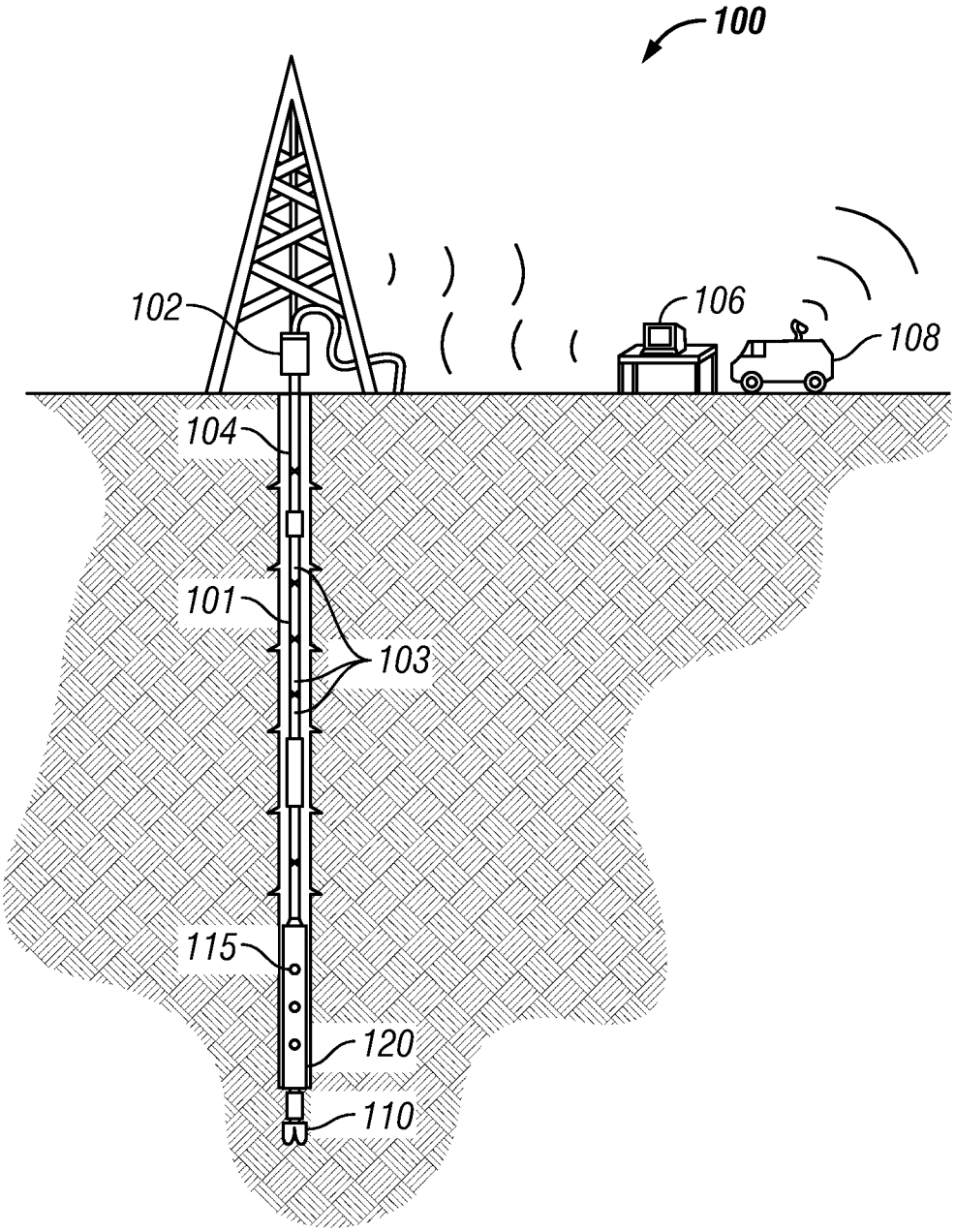
FIG. 3 is a schematic view, partly in cross-section, of a formation tester disposed on a wired drill pipe connected to a telemetry network.

Referring to FIG. 3, a telemetry network 100 is shown. A formation tester 120 is coupled to a drill string 101 formed by a series of wired drill pipes 103 connected for communication across junctions using communication elements as described below. It will be appreciated that work string 101 can be other forms of conveyance, such as coiled tubing or wired coiled tubing. A top-hole repeater unit 102 is used to interface the network 100 with drilling control operations and with the rest of the world. In one aspect, the repeater unit 402 rotates with the kelly 404 or top-hole drive and transmits its information to the drill rig by any known means of coupling rotary information to a fixed receiver. In another aspect, two communication elements can be used in a transition sub, with one in a fixed position and the other rotating relative to it (not shown). A computer 106 in the rig control center can act as a server, controlling access to network 100 transmissions, sending control and command signals downhole, and receiving and processing information sent up-hole. The software running the server can control access to the network 100 and can communicate this information, in encoded format as desired, via dedicated land lines, satellite link (through an uplink such as that shown at 108), Internet, or other means to a central server accessible from anywhere in the world. The testing tool 120 is shown linked into the network 100 just above the drill bit 110 for communication along its conductor path and along the wired drill string 101.

The tool 120 may include a plurality of transducers 115 disposed on the tool 120 to relay downhole information to the operator at surface or to a remote site. The transducers 115 may include any conventional source/sensor (e.g., pressure, temperature, gravity, etc.) to provide the operator with formation and/or borehole parameters, as well as diagnostics or position indication relating to the tool. The telemetry network 100 may combine multiple signal conveyance formats (e.g., mud pulse, fiber-optics, acoustic, EM hops, etc.). It will also be appreciated that software/firmware may be configured into the tool 120 and/or the network 100 (e.g., at surface, downhole, in combination, and/or remotely via wireless links tied to the network).

Figure 4:
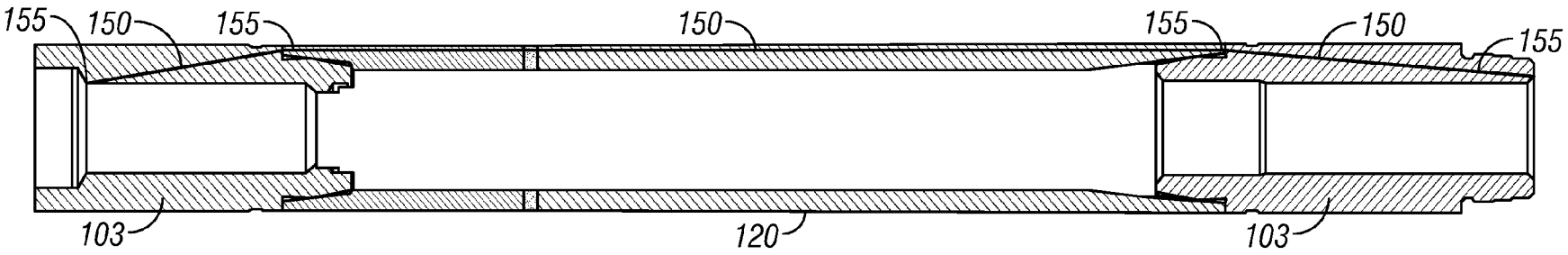
FIG. 4 is a cross-section view of a section of wired drill pipe including a wired tool.

Referring to FIG. 4, a section of the wired drill string 101 is shown including the formation tester 120. Conductors 150 traverse the entire length of the tool. Portions of wired drill pipes 103 may be subs or other connections means. In some embodiments, the conductor(s) 150 comprise coaxial cables, copper wires, optical fiber cables, triaxial cables, and twisted pairs of wire. The ends of the wired subs 103 are configured to communicate within a downhole network as described herein.

Communication elements 155 allow the transfer of power and/or data between the sub connections and through the tool 120. The communication elements 155 may comprise inductive couplers, direct electrical contacts, optical couplers, and combinations thereof. The conductor 150 may be disposed through a hole formed in the walls of the outer tubular members of the tool 120 and pipes 103. In some embodiments, the conductor 150 may be disposed part way within the walls and part way through the inside bore of the tubular members or drill collars. In some embodiments, a coating may be applied to secure the conductor 150 in place. In this way, the conductor 150 will not affect the operation of the testing tool 120. The coating should have good adhesion to both the metal of the pipe and any insulating material surrounding the conductor 150. Useable coatings 312 include, for example, a polymeric material selected from the group consisting of natural or synthetic rubbers, epoxies, or urethanes. Conductors 150 may be disposed on the subs using any suitable means.

Figure 5:
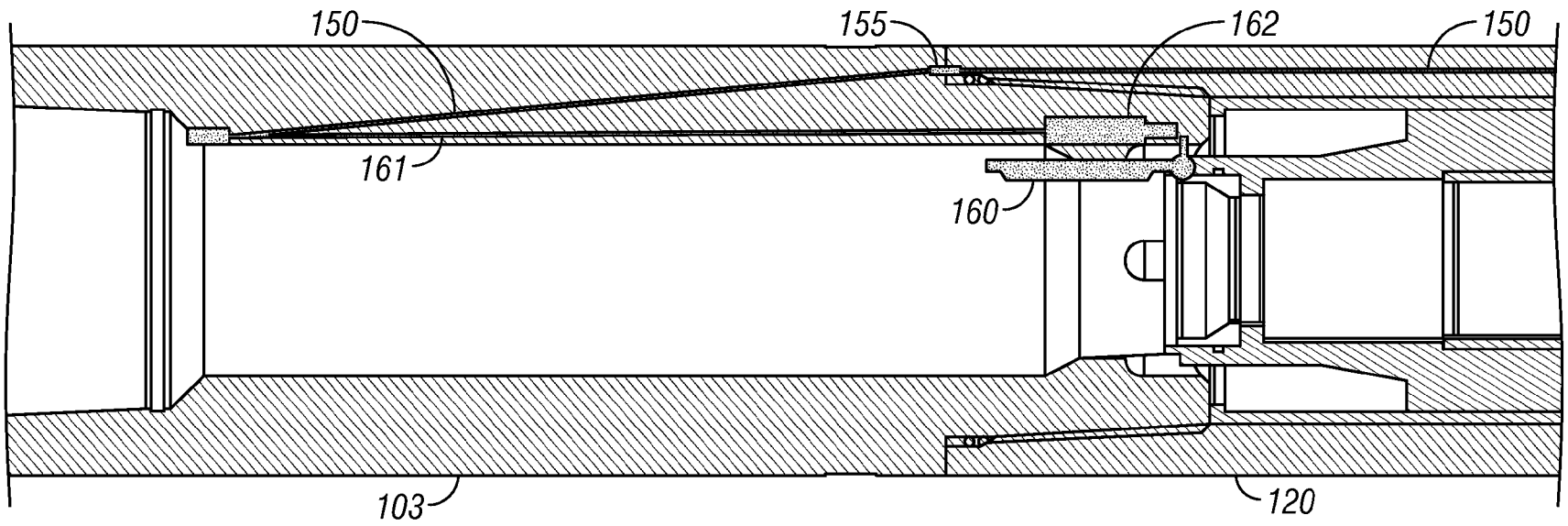
FIG. 5 is an enlarged of the wired drill pipe and wired tool of FIG. 4.

A data/power signal may be transmitted along the tool 120 from one end of the tool through the conductor(s) 150 to the other end across the communication elements 155. Referring to FIG. 5, the tool 120 includes an electronically controlled member 160. The actuatable member 160 may be actuated remotely by a signal communicated through conductor 150 to conductor 161 to trigger an actuator 162 (e.g., solenoid, servo, motor). The actuation signal for the actuator 162 can be distinguished from other signals transmitted along the conductors 150, 161 using conventional communication protocols (e.g., DSP, frequency multiplexing, etc.).

Figure 6:
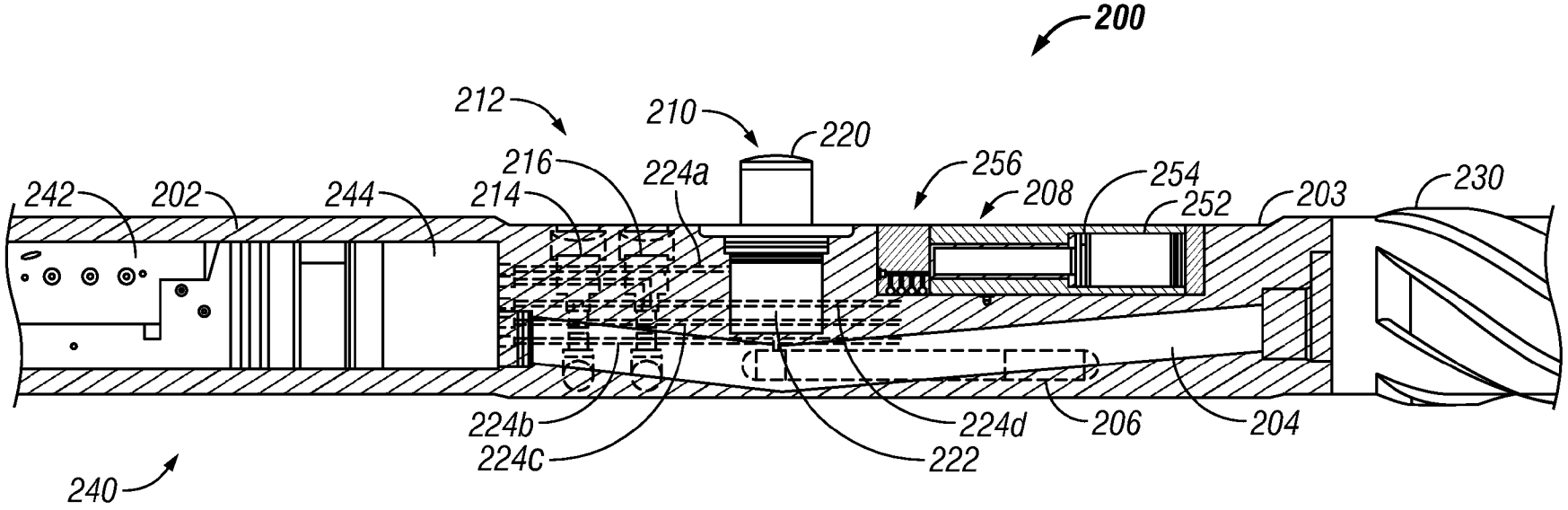
FIG. 6 is a side view, partly in cross-section, of a drill collar including a formation probe assembly.

Referring next to FIG. 6, an embodiment of an MWD formation probe collar section 200 is shown in detail, which may be used as the tool 10 in FIG. 1 or the tool 120 in FIG. 3. A drill collar 202 houses the formation tester or probe assembly 210. The probe assembly 210 includes various components for operation of the probe assembly 210 to receive and analyze formation fluids from the earth formation 9 and the reservoir 11. An extendable probe member 220 is disposed in an aperture 222 in the drill collar 202 and extendable beyond the drill collar 202 outer surface, as shown. The probe member 220 is retractable to a position recessed beneath the drill collar 102 outer surface, as shown with reference to the exemplary probe assembly 700 of FIG. 7. The probe assembly 210 may include a recessed outer portion 203 of the drill collar 202 outer surface adjacent the probe member 220. The probe assembly 210 includes a draw down piston assembly 208, a sensor 206, a valve assembly 212 having a flow line shutoff valve 214 and equalizer valve 216, and a drilling fluid flow bore 204. At one end of the probe collar 200, generally the lower end when the tool 10 is disposed in the borehole 8, is an optional stabilizer 230, and at the other end is an assembly 240 including a hydraulic system 242 and a manifold 244.

The draw down piston assembly 208 includes a piston chamber 252 containing a draw down piston 254 and a manifold 256 including various fluid and electrical conduits and control devices, as one of ordinary skill in the art would understand. The draw down piston assembly 208, the probe 220, the sensor 206 (e.g., a pressure gauge) and the valve assembly 212 communicate with each other and various other components of the probe collar 200, such as the manifold 244 and hydraulic system 242, as well as the tool 10 via conduits 224*a*, 224*b*, 224*c* and 224*d*. The conduits 224*a*, 224*b*, 224*c*, 224*d* include various fluid flow lines and electrical conduits for operation of the probe assembly 210 and probe collar 200.

For example, one of conduits 224*a*, 224*b*, 224*c*, 224*d* provides a hydraulic fluid to the probe 220 to extend the probe 220 and engage the formation 9. Another of these conduits provides hydraulic fluid to the draw down piston 254, actuating the piston 254 and causing a pressure drop in another of these conduits, a formation fluid flow line to the probe 220. The pressure drop in the flow line also causes a pressure drop in the probe 220, thereby drawing formation fluids into the probe 220 and the draw down piston assembly 208. Another of the conduits 224*a*, 224*b*, 224*c*, 224*d* is a formation fluid flow line communicating formation fluid to the sensor 206 for measurement, and to the valve assembly 212 and the manifold 244. The flow line shutoff valve 214 controls fluid flow through the flow line, and the equalizer valve 216 is actuatable to expose the flow line the and probe assembly 210 to a fluid pressure in an annulus surrounding the probe collar 200, thereby equalizing the pressure between the annulus and the probe assembly 210. The manifold 244 receives the various conduits 224*a*, 224*b*, 224*c*, 224*d*, and the hydraulic system 242 directs hydraulic fluid to the various components of the probe assembly 210 as just described. One or more of the conduits 224*a*, 224*b*, 224*c*, 224*d* are electrical for communicating power from a power source, and control signals from a controller in the tool, or from the surface of the well.

Drilling fluid flow bore 204 may be offset or deviated from a longitudinal axis of the drill collar 202, such that at least a portion of the flow bore 204 is not central in the drill collar 202 and not parallel to the longitudinal axis. The deviated portion of the flow bore 204 allows the receiving aperture 222 to be placed in the drill collar 202 such that the probe member 220 can be fully recessed below the drill collar 202 outer surface. Space for formation testing and other components is limited. Drilling fluid must also be able to pass through the probe collar 200 to reach the drill bit 7. The deviated or offset flow bore 204 allows an extendable sample device such as probe 220 and other probe embodiments described herein to retract and be protected as needed, and also to extend and engage the formation for proper formation testing.

Figure 7:
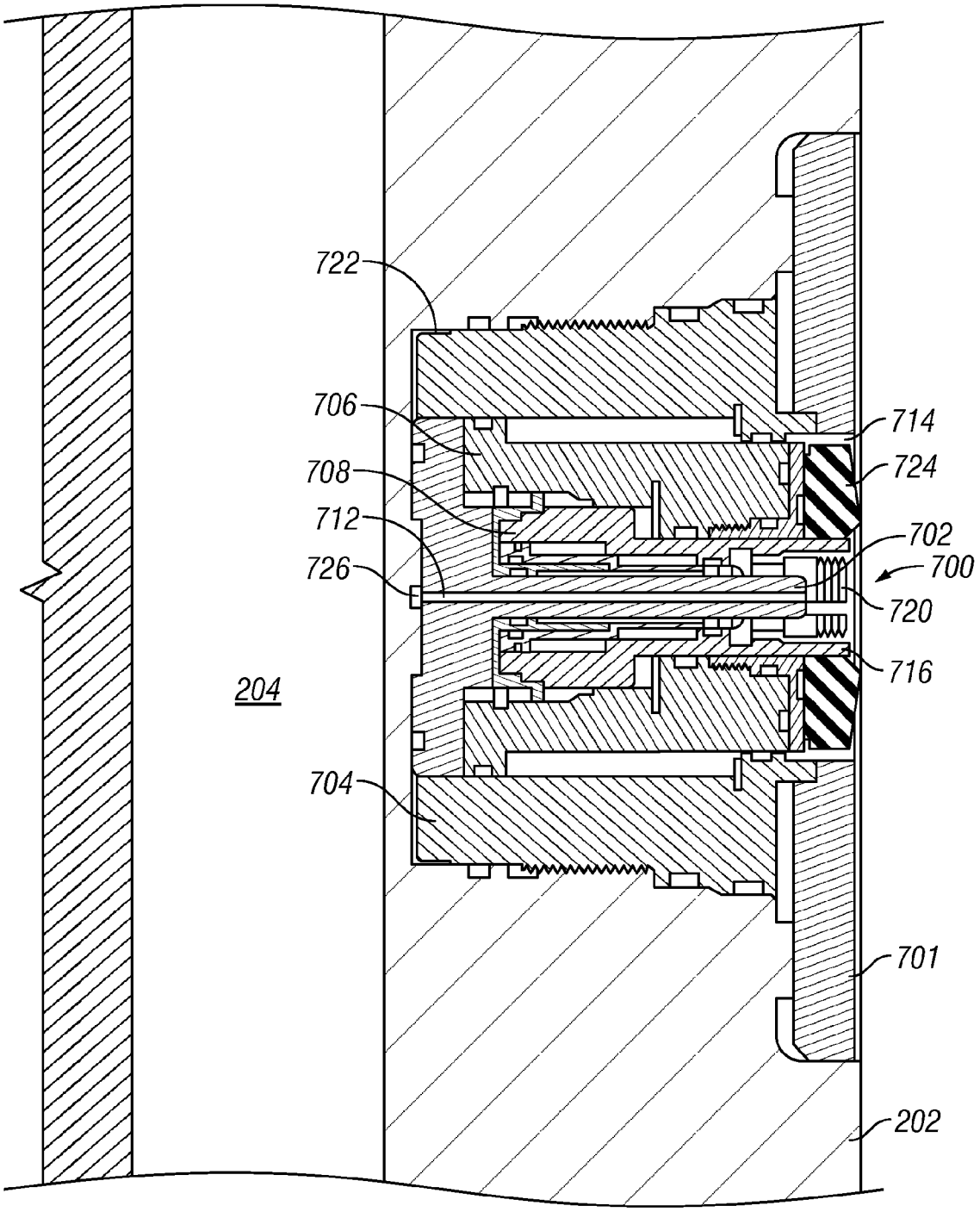
FIG. 7 is a cross-section view of an embodiment of a formation probe assembly in a retracted position.

Referring now to FIG. 7, an alternative embodiment to probe 120 is shown as probe 700. The probe 700 is retained in an aperture 722 in drill collar 102 by threaded engagement and also by cover plate 701 having aperture 714. Alternative means for retaining the probe 700 are consistent with the teachings herein. The probe 700 is shown in a retracted position, beneath the outer surface of the drill collar 202. The probe 700 generally includes a stem 702 having a passageway 712, a sleeve 704, a piston 706 adapted to reciprocate within the sleeve 704, and a snorkel assembly 708 adapted for reciprocal movement within the piston 706. The snorkel assembly 708 includes a snorkel 716. The end of the snorkel 716 may be equipped with a screen 720. Screen 720 may include, for example, a slotted screen, a wire mesh or a gravel pack. The end of the piston 706 may be equipped with a seal pad 724. The passageway 712 communicates with a port 726, which communicates with one of the conduits 224*a*, 224*b*, 224*c*, 224*d* for receiving and carrying a formation fluid.

Figure 8:
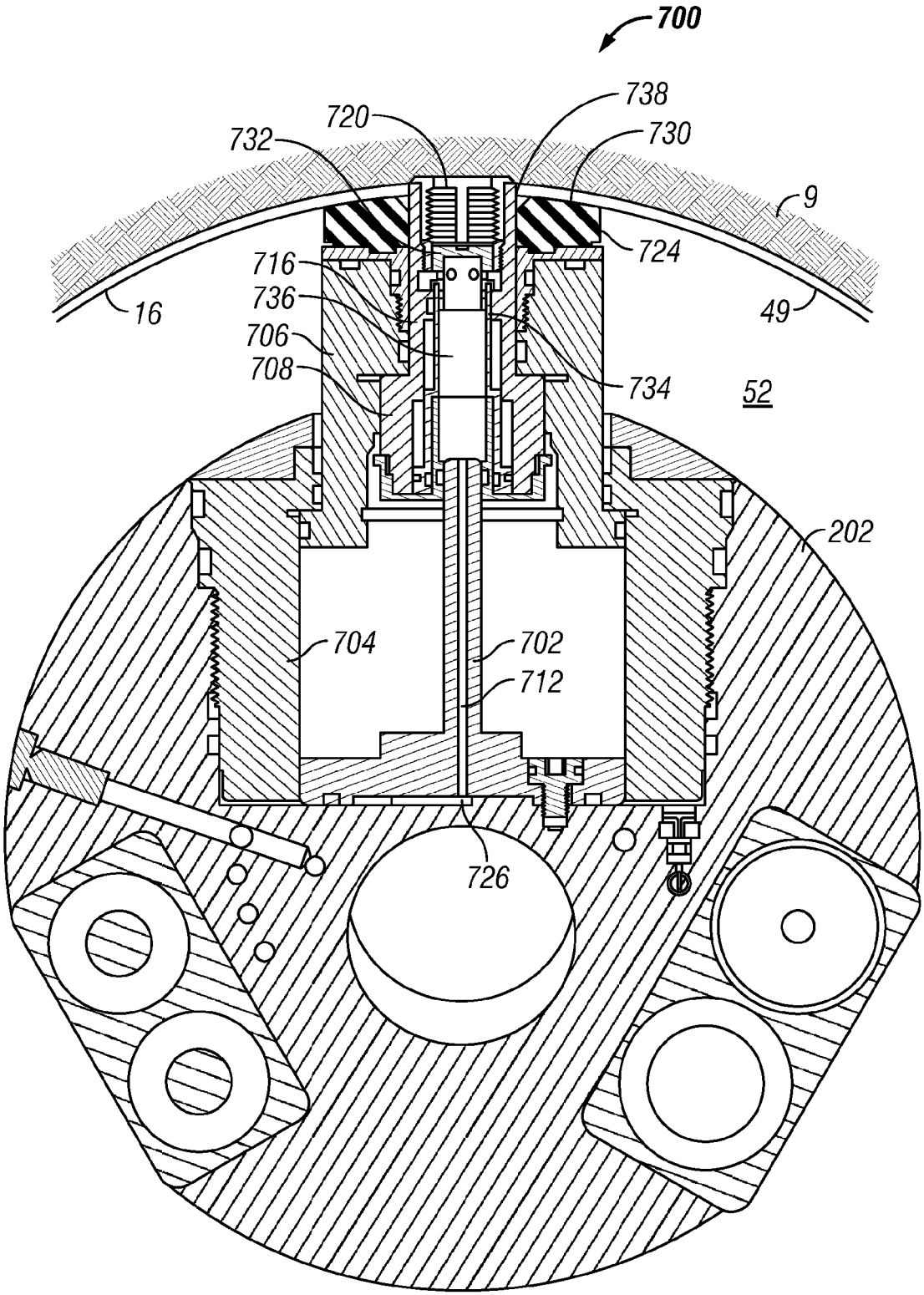
FIG. 8 is the formation probe assembly of FIG. 7 in an extended position.

Referring to FIG. 8, the probe 700 is shown in an extended position. The piston 706 is actuated within the sleeve 704 from a first position shown in FIG. 7 to a second position shown in FIG. 8, preferably by hydraulic pressure. The seal pad 724 is engaged with the borehole wall surface 16, which may include a mud or filter cake 49, to form a primary seal between the probe 700 and the borehole annulus 52. Then, the snorkel assembly 708 is actuated, by hydraulic pressure, for example, from a first position shown in FIG. 7 to a second position shown in FIG. 8. The snorkel 716 extends through an aperture 738 in the seal pad 724 and beyond the seal pad 724. The snorkel 716 extends through the interface 730 and penetrates the formation 9. The probe 700 may be actuated to withdraw formation fluids from the formation 9, into a bore 736 of the snorkel assembly 708, into the passageway 712 of the stem 702 and into the port 726. The screen 720 filters contaminants from the fluid that enters the snorkel 716. The probe 700 may be equipped with a scraper 732 and reciprocating scraper tube 734 to move the scraper 732 along the screen 720 to clear the screen 720 of filtered contaminants.

The seal pad 724 is preferably made of an elastomeric material. The elastomeric seal pad 724 seals and prevents drilling fluid or other borehole contaminants from entering the probe 700 during formation testing. In addition to this primary seal, the seal pad 724 tends to deform and press against the snorkel 716 that is extended through the seal pad aperture 738 to create a secondary seal.

Figure 9:
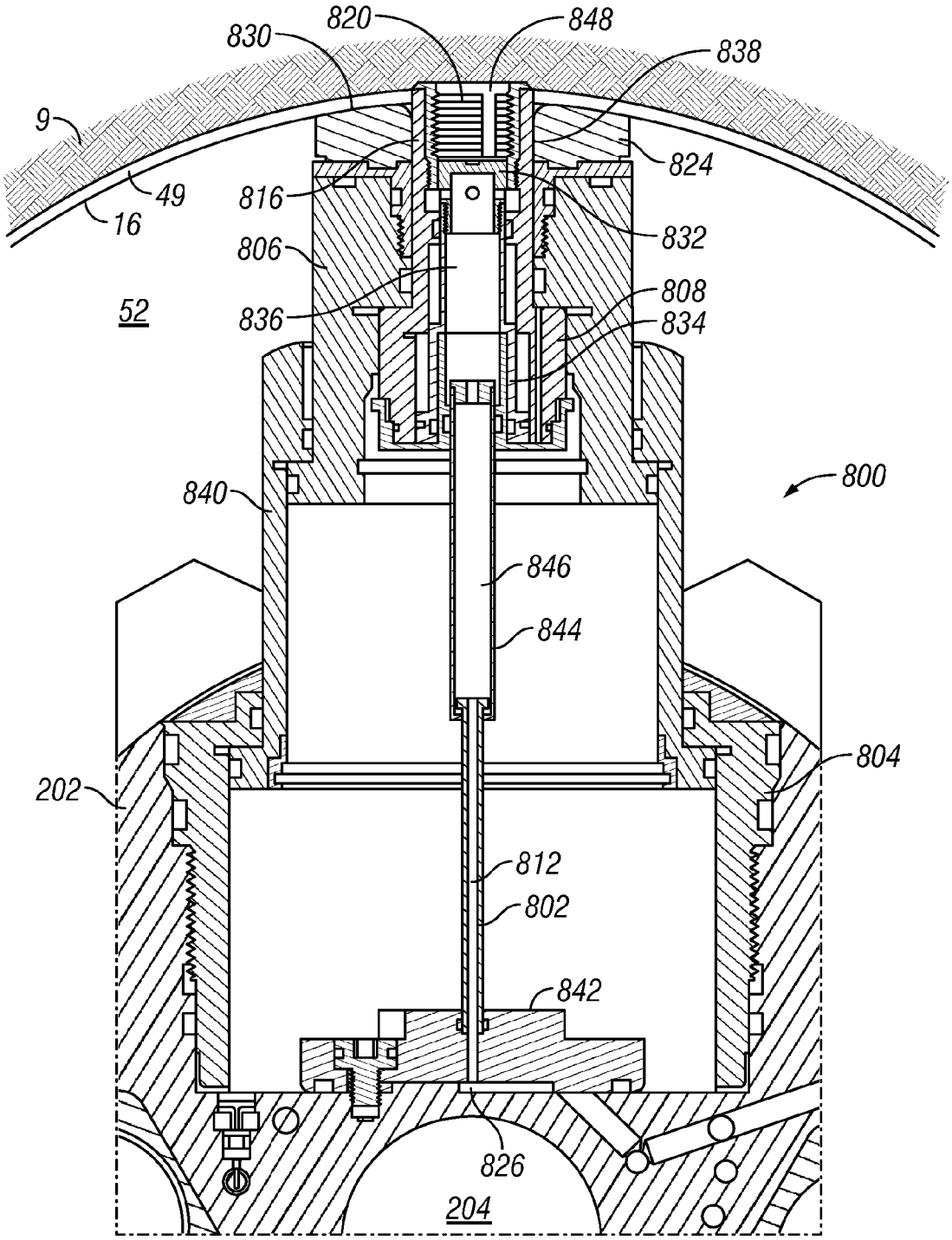
FIG. 9 is a cross-section view of another embodiment of a formation probe assembly in an extended position.

Another embodiment of the probe is shown as probe 800 in FIG. 9. Many of the features and operations of the probe 800 are similar to the probe 700. For example, the probe 800 includes a sleeve 804, a piston 806 and a snorkel assembly 808 having a snorkel 816, a screen 820, a scraper 832 and a scraper tube 834. In addition, the probe 800 includes an intermediate piston 840 and a stem extension 844 having a passageway 846. The intermediate piston 840 is extendable similar to the piston 806 and the piston 706. However, the piston 840 adds to the overall distance that the probe 800 is able to extend to engage the borehole wall surface 16. Both of the pistons 806 and 840 may be extended to engage and seal a seal pad 824 with the borehole wall surface 16. The seal pad 824 may include elastomeric materials such that seals are provided at a seal pad interface 830 and at a seal pad aperture 838. The snorkel 816 extends beyond the seal pad 824 and the interface 830 such that a formation penetrating portion 848 of the snorkel 816 penetrates the formation 9. Formation fluids may then be drawn into the probe 800 through a screen 820, into a bore 836, into the passageway 846, into a passageway 812 of a stem 802 and a base 842, and finally into a port 826.

Figure 10:
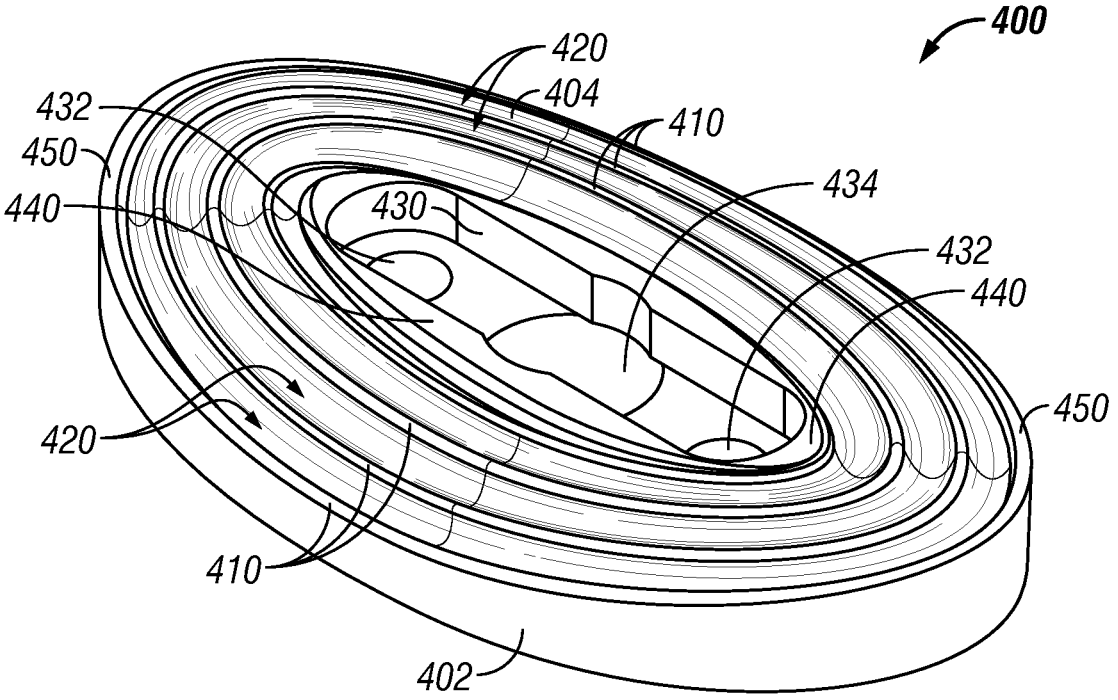
FIG. 10 is a perspective view of an embodiment of a skirt and seal pad assembly in accordance with the principles herein.
Figure 11:
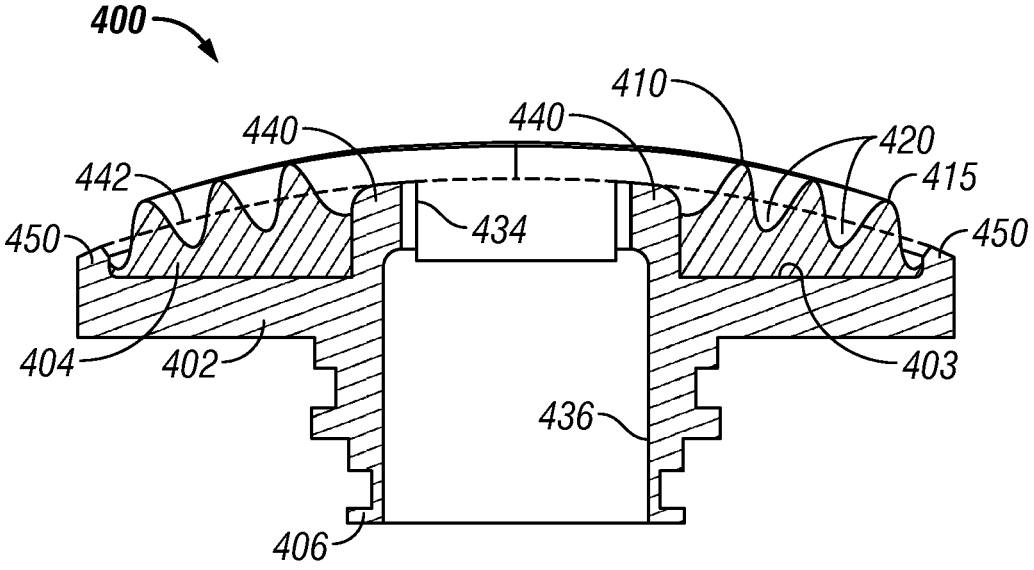
FIG. 11 is a cross-section view of the skirt and seal pad assembly of FIG. 10.

Referring to FIG. 10, an isolation or seal pad assembly 400 is shown for use in the various embodiments of the formation tester tools and probe assemblies described herein. The seal pad assembly 400 is attachable to the formation probes described herein, and a bore 434 receives the extendable sample probes or snorkels. The seal pad 400 further includes a metal skirt or support member 402 and the rubber or elastomeric pad element 404 coupled thereto. In some embodiments, the pad 404 is bonded to the metal skirt at a skirt base surface 403 (FIG. 11). In some embodiments, the skirt comprises materials other than metal. The pad 400 may be elliptical as shown, or round as indicated in further drawings herein.

The metal skirt 402 includes an outer raised edge 450 and an inner raised edge 440. The inner raised edge 440 surrounds an inner cavity 430 having bores 432, 434 for receiving various components of the formation testing tool. The elastomeric pad element 404 abuts the inner surfaces of the raised edges 440, 450 such that the pad fills the space therein and the raised edges support the deformable pad element 404. An outer surface of the pad element 404 includes ridges, ribs or raised portions 410 and alternating valleys, grooves or spaces 420.

Referring to FIG. 11, a cross-section of the pad 400 shows the metal skirt 402 supporting the pad element 404. The raised edges 440, 450 provide lateral support for the pad element 404, which will deform toward the edges as the outer surface is compressed and deformed against the formation wall. The edges 440, 450 capture the seal pad element so the element 404 cannot deform as far as it is capable, thereby reducing the stress on the element 404. Additionally, the ridges 410 are allowed to deform into the spaces 420 while under compression and deformation against the borehole wall. Because portions of the volume of the seal pad element 404 are disposed above an outer skirt profile or outer profile 442, and there are space volumes below the outer skirt profile 442, the volumes of the ridges 410 above the profile are allowed to deform into the spaces below and thereby reduce the load and stress on the pad element 404. The skirt 402 includes the connector 406 for connecting the assembly 400 to the formation probe assemblies described herein, and the bores 434, 436 for receiving the sample snorkels.

Figure 12:
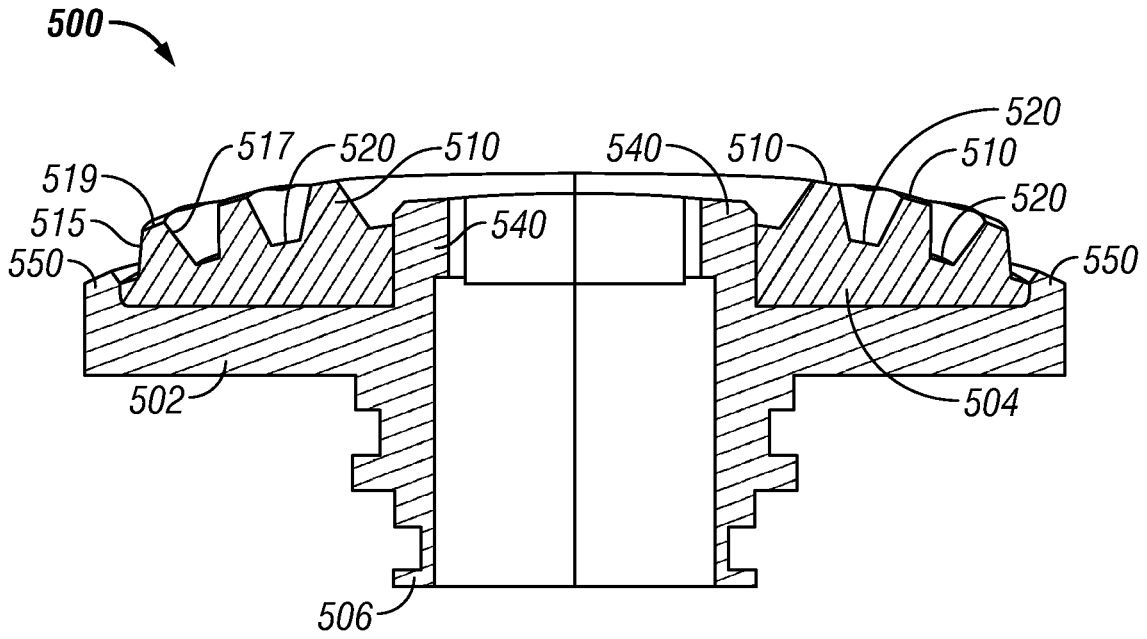
FIG. 12 is a cross-section view of another embodiment of a skirt and seal pad assembly in accordance with the principles herein.

In some embodiments, the seal pad element includes other configurations. Referring to FIG. 12, the seal pad assembly 500 includes a deformable elastomeric element 504 coupled to a skirt 502. The seal element 504 includes an angular profile 515 rather than the outer surface or rounded or sinusoidal profile 415 of FIG. 11. The angular profile includes the flat outer surfaces 519 and the angled side surfaces 517 that transition to the flat inner surfaces of the spaces 520. The pad element 504 is captured by the raised inner edge 540 and the raised outer edge 550. The outer surfaces 519 of the ribs or ridges 520 may be flat or include shaped surfaces, while the side surfaces 517 remain deformable into the spaces 520 during compression of the pad element 504 to reduce the load endured by the pad element 504. In some embodiments, the cross-sectional profile of the outer sealing surface of the seal pad element includes a combination of the rounded and angular shapes.

Figure 13:
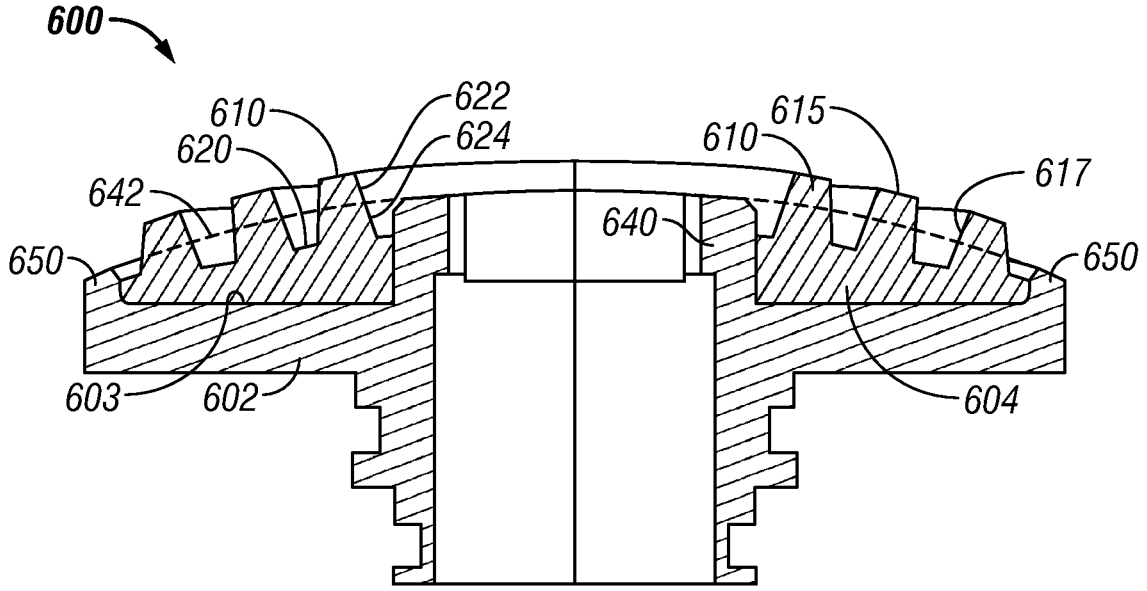
FIG. 13 is a cross-section view of a further embodiment of a skirt and seal pad assembly in accordance with the principles herein.

Referring to FIG. 13, the height and width of the ridges and spaces may be varied. In some embodiments, a pad element 604 of a seal pad assembly 600 includes ridges 610 extending away from a skirt 602. The ridges 610 include increased height relative to the inner surfaces of spaces 620. In some embodiments, the bases of the ridges 610 are decreased in width making the side surfaces 617 more upright. These variable configurations of the ridges 610 can be employed to vary the volume 622 of the ridges above an outer skirt profile 642 and the volume 624 of the ridges below the profile 642. The available volume of space below the profile 642 for receiving the deformed pad element 604 is also thereby variable. As shown in FIG. 13, as well as FIGS. 10-12, the volume of space below the outer skirt profile is separated into multiple volumes 620 alternating with the raised seal pad portions 610 forming the overall volume of seal pad material above the skirt profile.

In addition to the ridge and groove arrangements, the seal pad portions above the skirt profile and the spaces below the skirt profile may also be effected by other types of raised portions, such as projections and dimples or bumps and depressions.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A formation tester seal pad, comprising:

a moveable support member comprising:

an inner raised edge; and an outer raised edge, wherein the inner and outer raised edges define an outer profile of the support member; and a deformable seal pad element positioned between the inner and outer raised edges, the seal pad element comprising:

a volume of seal pad material above the outer profile of the support member; and a volume of seal pad material below the outer profile of the support member, wherein the seal pad element forms an outer sealing surface having a plurality of raised portions and a plurality of spaces;

wherein each raised portion is positioned between a pair of spaces; and wherein the raised portions are deformable into the spaces in response to a compressive load on the outer sealing surface.

2. A formation tester seal pad as defined in claim 1, wherein:

the raised portions comprise ridges; and the adjacent spaces are grooves to the ridges.

3. A formation tester seal pad as defined in claim 1, wherein the seal pad element comprises an elastomeric material.

4. A formation tester seal pad as defined in claim 1, wherein a profile of the outer sealing surface is rounded, angular or a combination thereof.

5. A formation tester seal pad as defined in claim 1, wherein:

the raised portions form the volume of seal pad material above the outer profile; and the spaces form the volume of seal pad material below the outer profile.

6. A formation tester seal pad as defined in claim 1, wherein the seal pad element comprises an aperture to receive a snorkel extendable beyond the outer sealing surface of the seal pad element.

* * * * *